US010115389B2

(12) United States Patent
Xie et al.

(10) Patent No.: US 10,115,389 B2
(45) Date of Patent: Oct. 30, 2018

(54) SPEECH SYNTHESIS METHOD AND APPARATUS

(71) Applicant: BAIDU ONLINE NETWORK TECHNOLOGY (BEIJING) CO., LTD., Beijing (CN)

(72) Inventors: Yan Xie, Beijing (CN); Xiulin Li, Beijing (CN); Jie Bai, Beijing (CN)

(73) Assignee: BAIDU ONLINE NETWORK TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 15/325,477

(22) PCT Filed: Nov. 24, 2015

(86) PCT No.: PCT/CN2015/095460
§ 371 (c)(1),
(2) Date: Jan. 11, 2017

(87) PCT Pub. No.: WO2017/008426
PCT Pub. Date: Jan. 19, 2017

(65) Prior Publication Data

US 2017/0200445 A1 Jul. 13, 2017

(30) Foreign Application Priority Data

Jul. 15, 2015 (CN) ..... 2015 1 0417099

(51) Int. Cl.
*G10L 13/047* (2013.01)
*G10L 13/07* (2013.01)
*G10L 13/08* (2013.01)

(52) U.S. Cl.
CPC ..... *G10L 13/047* (2013.01); *G10L 13/07* (2013.01); *G10L 13/08* (2013.01)

(58) Field of Classification Search
CPC ..... G10L 13/047; G10L 13/07; G10L 13/08
(Continued)

(56) References Cited

U.S. PATENT DOCUMENTS 6,233,545 B1 * 5/2001 Datig ..... G06N 3/004 704/2
2003/0061048 A1 * 3/2003 Wu ..... G10L 13/08 704/260

(Continued)

FOREIGN PATENT DOCUMENTS

CN 1384489 A 12/2002
CN 1501349 A 6/2004

(Continued)

OTHER PUBLICATIONS

Korean Intellectual Property Office, Notification of Reason for Refusal for KR10-2016-7028544, Sep. 29, 2017.

*Primary Examiner* — Bharatkumar S Shah
(74) *Attorney, Agent, or Firm* — Hodgson Russ LLP

(57) ABSTRACT

The present disclosure provides a speech synthesis method and apparatus. The speech synthesis method includes: processing a text, to obtain a to-be-synthesized text; if a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

17 Claims, 5 Drawing Sheets

(58) Field of Classification Search
USPC ..... 704/260
See application file for complete search history.

(56) References Cited

U.S. PATENT DOCUMENTS

| | | | | |
|---|---|---|---|---|
| 2007/0282592 | A1* | 12/2007 | Huang | G06F 17/2775 704/9 |
| 2010/0082350 | A1* | 4/2010 | Schultz | G10L 13/00 704/260 |
| 2014/0303961 | A1* | 10/2014 | Leydon | G06F 17/28 704/2 |
| 2014/0337007 | A1* | 11/2014 | Waibel | G06F 17/289 704/3 |

FOREIGN PATENT DOCUMENTS

| | | | |
|---|---|---|---|
| CN | 1559068 | A | 12/2004 |
| CN | 101409072 | A | 4/2009 |
| CN | 102568471 | A | 7/2012 |
| CN | 103077705 | | 5/2013 |
| JP | 2002312282 | A | 10/2002 |
| JP | 2005055607 | A | 3/2005 |
| WO | 2014186143 | | 11/2014 |

* cited by examiner

SPEECH SYNTHESIS METHOD AND APPARATUS

CROSS-REFERENCE TO RELATED APPLICATION

This application claims priority to Chinese Patent Application No. "201510417099.X", filed by Baidu Online Network Technology (Beijing) Co., Ltd. on Jul. 15, 2015 and entitled "SPEECH SYNTHESIS METHOD AND APPARATUS".

FIELD

The present disclosure relates to the technical field of speech processing, and in particular, to a speech synthesis method and apparatus.

BACKGROUND

Based on service provision manners, a speech synthesis technology may include speech synthesis based on a cloud engine (briefly referred to as "online speech synthesis" below) and speech synthesis based on a local engine (briefly referred to as "offline speech synthesis" below). The two speech synthesis technologies have respective advantages and disadvantages. The online speech synthesis has advantages such as high naturalness, high real-time performance, and not occupying a client device resource, but its disadvantages are also obvious, that is, since an application (briefly referred to as App below) using the speech synthesis may send a long text to a server end at a time, but speech data synthesized by the server end is returned in segments to a client in which the App is installed, and the speech data is large in amount even if compressed (for example, 4 kb/s), if a network environment is not stable, the online speech synthesis becomes very slow and is not consecutive. However, the offline speech synthesis does not have network dependency, and can ensure stability of the synthesis service, but has a poorer synthesis effect than the online synthesis.

In conclusion, in the related art, products using the speech synthesis technology are all based on separate online speech synthesis or separate offline speech synthesis. The online speech synthesis consumes a large amount of data traffic, and when encountering a network error, can only prompt a user that the error occurs, and the offline speech synthesis does not have a natural effect. Therefore, user experience is poor.

SUMMARY

An objective of the present disclosure is to at least solve one of the technical problems in the related art to some extent.

Therefore, a first objective of the present disclosure is to provide a speech synthesis method. According to the method, advantages of online speech synthesis and offline speech synthesis are combined, and a speech synthesis service that is more stable and has a more natural effect can be provided, ensuring that a speech synthesis request of a user can be completed smoothly, and improving approval of the user for the speech synthesis service and user experience.

A second objective of the present disclosure is to provide a speech synthesis apparatus.

To achieve the objectives, according to a first aspect of embodiments of the present disclosure, a speech synthesis method is provided. The method includes: processing a text, to obtain a to-be-synthesized text; if a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

In the speech synthesis method in this embodiment of the present disclosure, when a network connection exists, a to-be-synthesized text is sent to an online speech synthesis system for speech synthesis, and if a fault occurs in the online speech synthesis system in a process in which the online speech synthesis system performs speech synthesis or the network connection is disrupted in an actual use process, a text for which the online speech synthesis system has not completed speech synthesis is sent to an offline speech synthesis system for speech synthesis, so that advantages of online speech synthesis and offline speech synthesis can be combined, and a speech synthesis service that is more stable and has a more natural effect can be provided, ensuring that a speech synthesis request of a user can be completed smoothly, and improving approval of the user for the speech synthesis service and user experience.

To achieve the objectives, according to a second aspect of embodiments of the present disclosure, a speech synthesis apparatus is provided, and the apparatus includes: a text processing module, configured to process a text, to obtain a to-be-synthesized text; and a sending module, configured to send the to-be-synthesized text obtained by the text processing module to an online speech synthesis system for speech synthesis if a network connection exists, and to send a text for which the online speech synthesis system has not completed speech synthesis to an offline speech synthesis system for speech synthesis if a fault occurs in the online speech synthesis system in a process in which the online speech synthesis system performs speech synthesis or the network connection is disrupted in an actual use process.

In the speech synthesis apparatus in this embodiment of the present disclosure, when a network connection exists, the sending module sends a to-be-synthesized text to an online speech synthesis system for speech synthesis, and if a fault occurs in the online speech synthesis system in a process in which the online speech synthesis system performs speech synthesis or the network connection is disrupted in an actual use process, sends a text for which the online speech synthesis system has not completed speech synthesis to an offline speech synthesis system for speech synthesis, so that advantages of online speech synthesis and offline speech synthesis can be combined, and a speech synthesis service that is more stable and has a more natural effect can be provided, ensuring that a speech synthesis request of a user can be completed smoothly, and improving approval of the user for the speech synthesis service and user experience.

Embodiments of the present disclosure further provide an electronic device, including: one or more processors; a memory; and one or more programs, stored in the memory, and when executed by the one or more processors, cause following operations to be executed: processing a text, to obtain a to-be-synthesized text; if a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

Embodiments of the present disclosure further provides a non-transitory computer storage medium, having stored therein one or more modules that, when executed, cause the following operations to be executed: processing a text, to obtain a to-be-synthesized text; if a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

Additional aspects and advantages of the present disclosure are set forth in the following descriptions, some of which will become obvious in the following descriptions, or be learned through practice of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

The following describes in detail embodiments of the present disclosure. Examples of the embodiments are shown in the accompanying drawings, where numerals that are the same or similar from beginning to end represent same or similar modules or modules that have same or similar functions. The following embodiments described with reference to the accompanying drawings are exemplary, and are intended only to describe the present disclosure and cannot be construed as a limitation to the present disclosure. On the contrary, the embodiments of the present disclosure include all changes, modifications, and equivalents that do not depart from the spirit and connotation scope of the appended claims.

Figure 1:
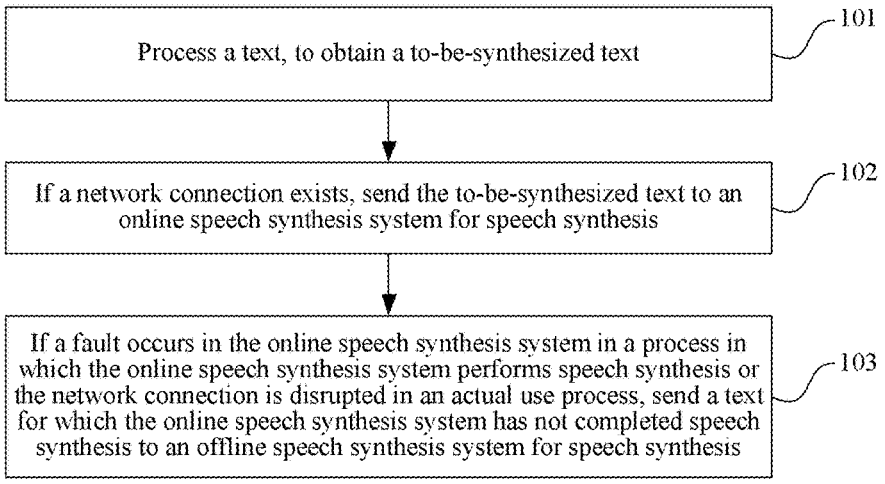
FIG. 1 is a flow chart of a speech synthesis method according to an embodiment of the present disclosure.

FIG. 1 is a flow chart of a speech synthesis method according to an embodiment of the present disclosure. As shown in FIG. 1, the speech synthesis method may include following steps.

In step 101, a text is processed, to obtain a to-be-synthesized text.

Specifically, processing a text may include performing punctuation and sentence segmentation, part-of-speech tagging, numeric character processing, pinyin annotation, and rhythm and pause prediction processing for the text.

"前方 400 米有闯红灯拍照" is used as an example First, punctuation and sentence segmentation, part-of-speech tagging, and numeric character processing are performed so that a sequence "前方 f 四百/m 米 q 有 v 闯红灯 v 拍照 v" is obtained, where the part behind a slash is an abbreviation of a part of speech, and polyphonic word analysis is performed according to the part of speech during pinyin annotation. Then, the pinyin annotation is performed so that a sequence "qian2 fang1 si4 bai2 mi3 you3 chuang3 hong2 deng1 pai1 zhao4" is obtained. Finally, rhythms and pauses are predicted, and a sequence "前方 四百米 $ 有 闯红灯 拍照 $" is obtained after processing, where a space represents a short pause, and the symbol $ represents a long pause.

In step 102, if a network connection exists, the to-be-synthesized text is sent to an online speech synthesis system for speech synthesis.

In this embodiment, when a network connection exists, a client sends the to-be-synthesized text to an online speech synthesis system for speech synthesis. The online speech synthesis system concatenates recorded sound segments into a sentence according to a particular rule by using a waveform concatenation synthesis method. This synthesis method has advantages that sound has good quality, sounds nature, and is more like human pronunciation. To achieve effects that sound has good quality, sounds nature, and is more like human pronunciation, a cloud sound library model is generally huge (generally reaches several Gs), and cannot be applied locally.

In step 103, if a fault occurs in the online speech synthesis system in a process in which the online speech synthesis system performs speech synthesis or the network connection is disrupted in an actual use process, a text for which the online speech synthesis system has not completed speech synthesis is sent to an offline speech synthesis system for speech synthesis.

In this embodiment, if a fault occurs in the online speech synthesis system in a process in which the online speech synthesis system performs speech synthesis or the network connection is disrupted in an actual use process, the client sends a text for which the online speech synthesis system has not completed speech synthesis to an offline speech synthesis system for speech synthesis. The offline speech synthesis system generally uses a parameter synthesis method, which needs to extract acoustic parameters from a sound library in advance, and then reconstruct sound by using the acoustic parameters and a voice encoder. With this method, the amount of sound library data that needs to be stored can be reduced to M bytes, so that offline speech synthesis can be used on a mobile device such as a mobile phone. However, because the acoustic parameters are not real sound, naturalness and quality of sound synthesized by the offline speech synthesis system are worse than those of the online speech synthesis system.

Further, after the speech synthesis is completed, the client may concatenate speech data of the online speech synthesis system and speech data of the offline speech synthesis system, to obtain complete speech synthesis data.

In the above speech synthesis method, when a network connection exists, a to-be-synthesized text is sent to an online speech synthesis system for speech synthesis, and if a fault occurs in the online speech synthesis system in a process in which the online speech synthesis system performs speech synthesis or the network connection is disrupted in an actual use process, a text for which the online speech synthesis system has not completed speech synthesis is sent to an offline speech synthesis system for speech synthesis, so that advantages of online speech synthesis and offline speech synthesis can be combined, and a speech synthesis service that is more stable and has a more natural effect can be provided, ensuring that a speech synthesis request of a user can be completed smoothly, and improving approval of the user for the speech synthesis service and user experience.

Figure 2:
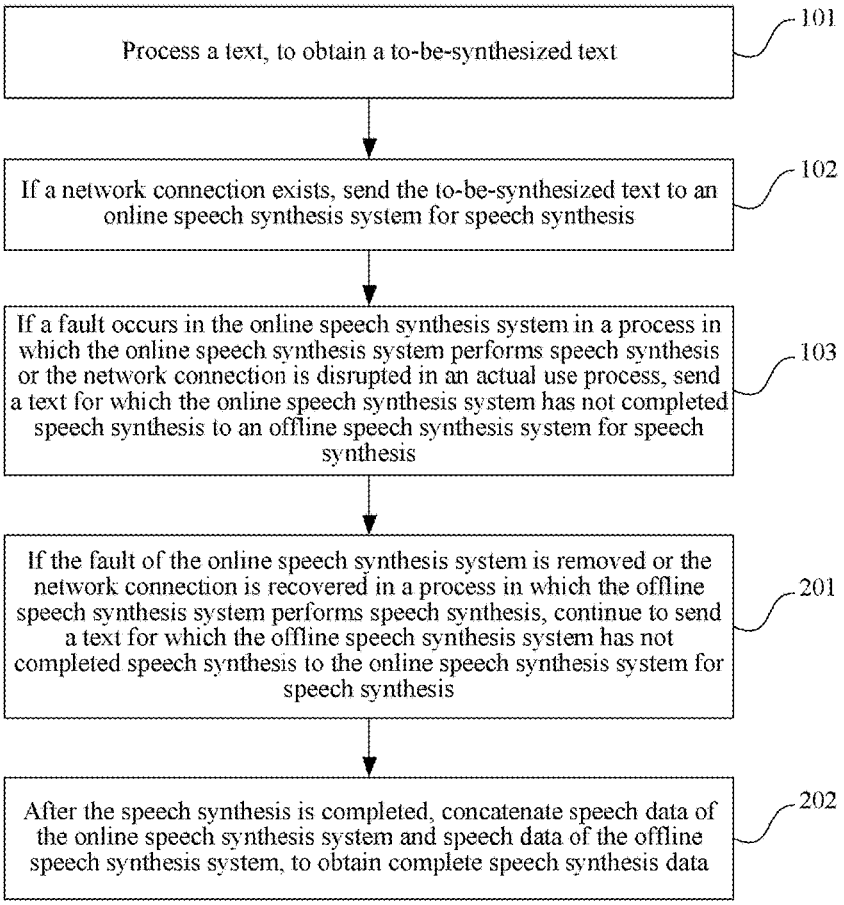
FIG. 2 is a flow chart of a speech synthesis method according to another embodiment of the present disclosure.

FIG. 2 is a flow chart of a speech synthesis method according to another embodiment of the present disclosure. As shown in FIG. 2, after step 103, the speech synthesis method may further include following steps.

In step 201, if the fault of the online speech synthesis system is removed or the network connection is recovered in a process in which the offline speech synthesis system performs speech synthesis, a text for which the offline speech synthesis system has not completed speech synthesis is sent to the online speech synthesis system for speech synthesis continuously.

That is, if a fault occurs in the online speech synthesis system in a process in which the online speech synthesis system performs speech synthesis or the network connection is disrupted in an actual use process, the client sends a text for which the online speech synthesis system has not completed speech synthesis to the offline speech synthesis system for speech synthesis, and at the same time, the client continuously detects whether the fault of the online speech synthesis system is removed or the network connection of the client is recovered. Once the client determines that the fault of the online speech synthesis system is removed or the network connection of the client is recovered, the client continues to send a text for which the offline speech synthesis system has not completed speech synthesis to the online speech synthesis system for speech synthesis. That is, in this embodiment, the client preferentially uses the online speech synthesis system to perform speech synthesis, so as to obtain a better speech synthesis effect. Only when a fault occurs in the online speech synthesis system in a process in which the online speech synthesis system performs speech synthesis or the network connection of the client is disrupted in an actual use process, the client sends a text for which the online speech synthesis system has not completed speech synthesis to the offline speech synthesis system for speech synthesis.

In step 202, after the speech synthesis is completed, speech data of the online speech synthesis system and speech data of the offline speech synthesis system is concatenated, to obtain complete speech synthesis data.

Figure 3:
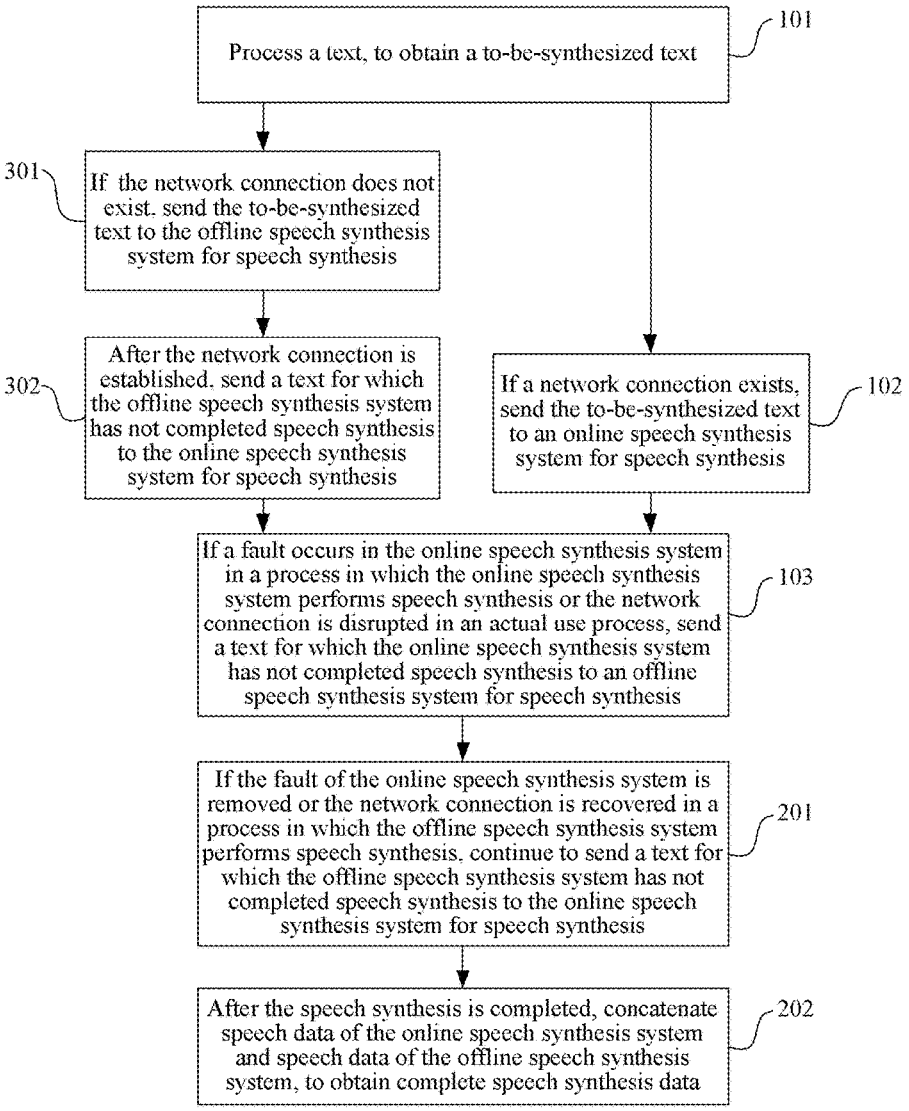
FIG. 3 is a flow chart of a speech synthesis method according to still another embodiment of the present disclosure.

FIG. 3 is a flow chart of a speech synthesis method according to still another embodiment of the present disclosure. As shown in FIG. 3, after step 101 and before step 103, the speech synthesis method may further include following steps.

In step 301, if the network connection does not exist, the to-be-synthesized text is sent to the offline speech synthesis system for speech synthesis.

In step 302, after the network connection is established, a text for which the offline speech synthesis system has not completed speech synthesis is sent to the online speech synthesis system for speech synthesis.

In this embodiment, after a to-be-synthesized text is obtained, if a network connection does not exist, a client first sends the to-be-synthesized text to an offline speech synthesis system for speech synthesis, and then the client continuously detects whether the network connection is established. After detecting that the network connection is established, the client sends a text for which the offline speech synthesis system has not completed speech synthesis to an online speech synthesis system for speech synthesis.

Figure 4:
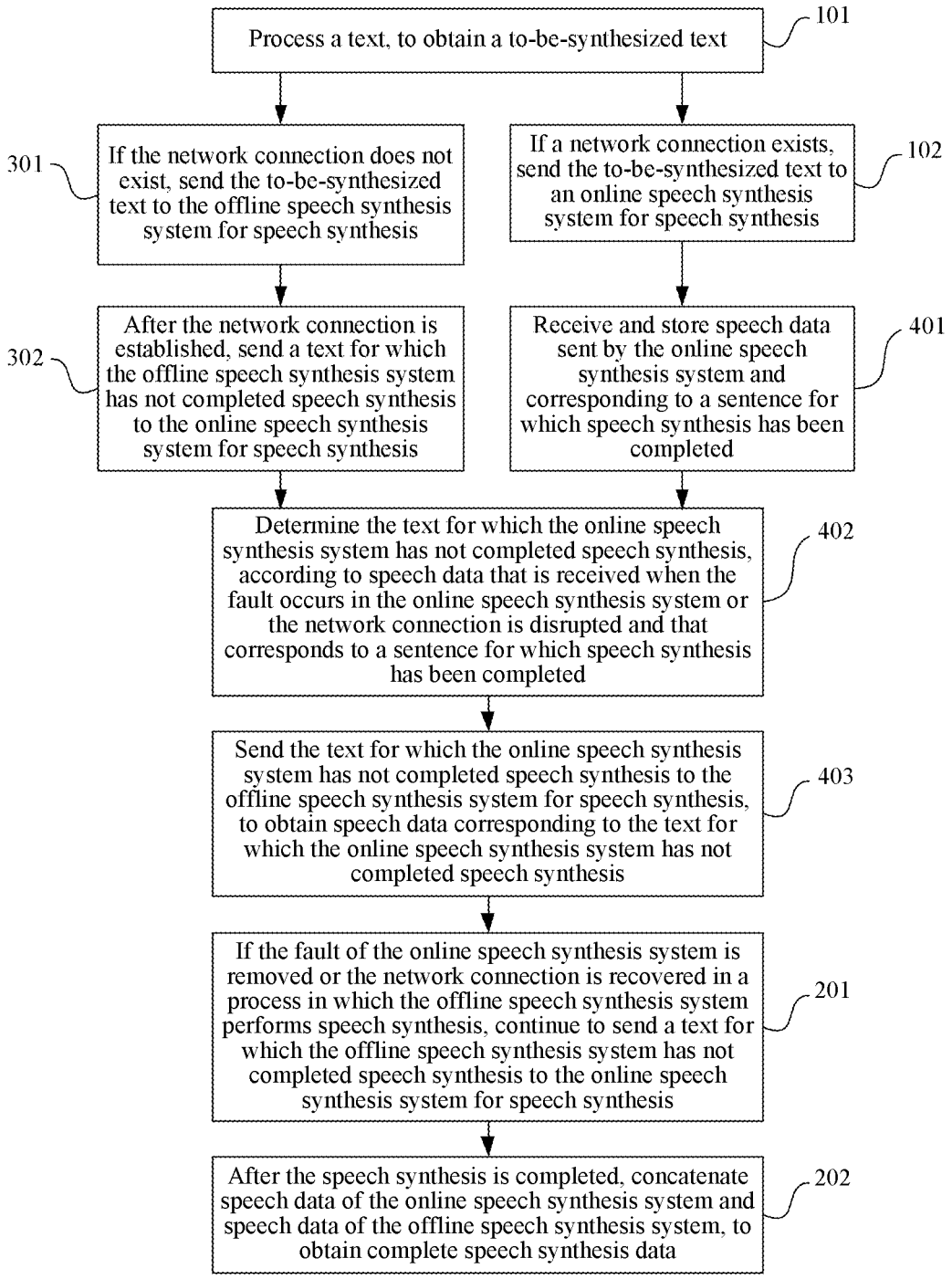
FIG. 4 is a flow chart of a speech synthesis method according to still yet another embodiment of the present disclosure.

FIG. 4 is a flow chart of a speech synthesis method according to still yet another embodiment of the present disclosure. As shown in FIG. 4, after step 102, the speech synthesis method may further include following steps.

In step 401, speech data sent by the online speech synthesis system and corresponding to a sentence for which speech synthesis has been completed is received and stored. The speech data corresponding to the sentence for which speech synthesis has been completed is obtained by the online speech synthesis system by performing punctuation for the to-be-synthesized text and performing speech synthesis for each sentence obtained after the punctuation.

For example, for a to-be-synthesized text t, when the network connection exists, the client sends the to-be-synthesized text t to the online speech synthesis system, and after receiving the to-be-synthesized text t, the online speech synthesis system performs punctuation for the to-be-synthesized text t, to obtain [t1, t2, t3, . . . ], then performs speech synthesis for [t1, t2, t3, . . . ], and sends obtained speech data [a1, a2, a3, . . . ] to the client.

In this embodiment, step 103 may include following steps.

In step 402, the text for which the online speech synthesis system has not completed speech synthesis is determined according to speech data that is received when the fault occurs in the online speech synthesis system or the network connection is disrupted and that corresponds to a sentence for which speech synthesis has been completed.

For example, if a fault occurs in the online speech synthesis system in a process in which the online speech synthesis system performs speech synthesis or the network connection of the client is disrupted in an actual use process, the client may determine, according to speech data (assumed as [a1, a2]) that is received when the fault occurs in the online speech synthesis system or the network connection is disrupted and that corresponds to a sentence for which speech synthesis has been completed, that an error occurs when speech data corresponding to t3 is obtained. Therefore, the client may determine that the text for which the online speech synthesis system has not completed speech synthesis is t3 and a subsequent text.

In step 403, the text for which the online speech synthesis system has not completed speech synthesis is sent to the offline speech synthesis system for speech synthesis, to obtain speech data corresponding to the text for which the online speech synthesis system has not completed speech synthesis.

Specifically, after determining that the text for which the online speech synthesis system has not completed speech synthesis is t3 and the subsequent text, the client needs to forward t3 and the subsequent text to the offline speech synthesis system for speech synthesis, to obtain speech data [a3', . . . ] corresponding to t3 and the subsequent text.

In this embodiment, after the speech synthesis is completed, the client may concatenate speech data of the online speech synthesis system and speech data of the offline speech synthesis system, to obtain complete speech synthesis data [a1, a2, a3', . . . ].

According to the speech synthesis method, speech synthesis experience of a user can be improved, the limitation from a network environment can be overcome, and a speech synthesis request of the user can be completed in various network environments. In addition, a better synthesis effect can be obtained as compared with separate offline speech synthesis, and a speech synthesis service becomes more stable and reliable.

Figure 5:
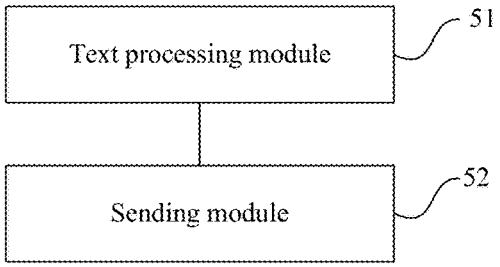
FIG. 5 is a block diagram of a speech synthesis apparatus according to an embodiment of the present disclosure.

FIG. 5 is a block diagram of a speech synthesis apparatus according to an embodiment of the present disclosure. The speech synthesis apparatus in this embodiment may serve as a client or a part of a client to implement the process in the embodiment shown in FIG. 1 of the present disclosure, where the client may be installed in a smart mobile terminal, and the smart mobile terminal may be a smartphone and/or a tablet computer or the like, which is not limited in this embodiment.

As shown in FIG. 5, the speech synthesis apparatus may include: a text processing module 51 and a sending module 52.

The text processing module 51 is configured to process a text, to obtain a to-be-synthesized text. In this embodiment, the text processing module 51 is specifically configured to perform punctuation and sentence segmentation, part-of-speech tagging, numeric character processing, pinyin annotation, and rhythm and pause prediction processing for the text.

"前方 400 米有闯红灯拍照" is used as an example. First, the text processing module 51 performs punctuation and sentence segmentation, part-of-speech tagging, and numeric character processing, so that a sequence "前方 f 四百/m 米 q 有 v 闯红灯 v 拍照 v" is obtained, where the part behind a slash is an abbreviation of a part of speech, and polyphonic word analysis is performed according to the part of speech during pinyin annotation. Then, the text processing module 51 performs the pinyin annotation so that a sequence "qian2 fang1 si4 bai2 mi3 you3 chuang3 hong2 deng1 pai1 zhao4" is obtained. Finally, the text processing module 51 predicts rhythms and pauses, and a sequence "前方 四百米 $ 有 闯红灯 拍照 $" is obtained after processing, where a space represents a short pause, and the symbol $ represents a long pause.

The sending module 52 is configured to send the to-be-synthesized text obtained by the text processing module 51 to an online speech synthesis system for speech synthesis if a network connection exists, and send a text for which the online speech synthesis system has not completed speech synthesis to an offline speech synthesis system for speech synthesis if a fault occurs in the online speech synthesis system in a process in which the online speech synthesis system performs speech synthesis or the network connection is disrupted in an actual use process.

In this embodiment, when a network connection exists, the sending module 52 sends the to-be-synthesized text to an online speech synthesis system for speech synthesis. The online speech synthesis system concatenates recorded sound segments into a sentence according to a particular rule by using a waveform concatenation synthesis method. This synthesis method has advantages that sound has good quality, sounds nature, and is more like human pronunciation. To achieve effects that sound has good quality, sounds nature, and is more like human pronunciation, a cloud sound library model is generally huge (generally reaches several Gs), and cannot be applied locally.

If a fault occurs in the online speech synthesis system in a process in which the online speech synthesis system performs speech synthesis or the network connection is disrupted in an actual use process, the sending module 52 sends a text for which the online speech synthesis system has not completed speech synthesis to an offline speech synthesis system for speech synthesis. The offline speech synthesis system generally uses a parameter synthesis method, which needs to extract acoustic parameters from a sound library in advance, and then reconstruct sound by using the acoustic parameters and a voice encoder. With this method, the amount of sound library data that needs to be stored can be reduced to M bytes, so that offline speech synthesis can be used on a mobile device such as a mobile phone. However, because the acoustic parameters are not real sound, naturalness and quality of sound synthesized by the offline speech synthesis system are worse than those of the online speech synthesis system.

Further, the sending module 52 is further configured to continue to send a text for which the offline speech synthesis system has not completed speech synthesis to the online speech synthesis system for speech synthesis, if the fault of the online speech synthesis system is removed or the network connection is recovered in a process in which the offline speech synthesis system performs speech synthesis.

That is, if a fault occurs in the online speech synthesis system in a process in which the online speech synthesis system performs speech synthesis or the network connection is disrupted in an actual use process, the sending module 52 sends a text for which the online speech synthesis system has not completed speech synthesis to the offline speech synthesis system for speech synthesis, and at the same time, the client continuously detects whether the fault of the online speech synthesis system is removed or the network connection of the client is recovered. Once the client determines that the fault of the online speech synthesis system is removed or the network connection of the client is recovered, the sending module 52 continues to send a text for which the offline speech synthesis system has not completed speech synthesis to the online speech synthesis system for speech synthesis. That is, in this embodiment, the client preferentially uses the online speech synthesis system to perform speech synthesis, so as to obtain a better speech synthesis effect. Only when a fault occurs in the online speech synthesis system in a process in which the online speech synthesis system performs speech synthesis or the network connection of the client is disrupted in an actual use process, the sending module 52 sends a text for which the online speech synthesis system has not completed speech synthesis to the offline speech synthesis system for speech synthesis.

Further, the sending module 52 is further configured to send the to-be-synthesized text obtained by the text processing module 51 to the offline speech synthesis system for speech synthesis if the network connection does not exist, and to send a text for which the offline speech synthesis system has not completed speech synthesis to the online speech synthesis system for speech synthesis after the network connection is established.

In this embodiment, after the text processing module 51 obtains a to-be-synthesized text, if a network connection does not exist, the sending module 52 first sends the to-be-synthesized text to an offline speech synthesis system for speech synthesis, and then the client continuously detects whether the network connection is established. After it is detected that the network connection is established, the sending module 52 sends a text for which the offline speech synthesis system has not completed speech synthesis to an online speech synthesis system for speech synthesis. Afterwards, if a fault occurs in the online speech synthesis system in a process in which the online speech synthesis system performs speech synthesis or the network connection is disrupted in an actual use process, the sending module 52 may further send a text for which the online speech synthesis system has not completed speech synthesis to the offline speech synthesis system for speech synthesis, and after the fault of the online speech synthesis system is removed or the network connection is recovered, continue to send a text for which the offline speech synthesis system has not completed speech synthesis to the online speech synthesis system for speech synthesis.

In the above speech synthesis apparatus, when a network connection exists, the sending module 52 sends a to-be-synthesized text to an online speech synthesis system for speech synthesis, and if a fault occurs in the online speech synthesis system in a process in which the online speech synthesis system performs speech synthesis or the network connection is disrupted in an actual use process, the sending module 52 sends a text for which the online speech synthesis system has not completed speech synthesis to an offline speech synthesis system for speech synthesis, so that advantages of online speech synthesis and offline speech synthesis can be combined, and a speech synthesis service that is more stable and has a more natural effect can be provided, ensuring that a speech synthesis request of a user can be completed smoothly, and improving approval of the user for the speech synthesis service and user experience.

Figure 6:
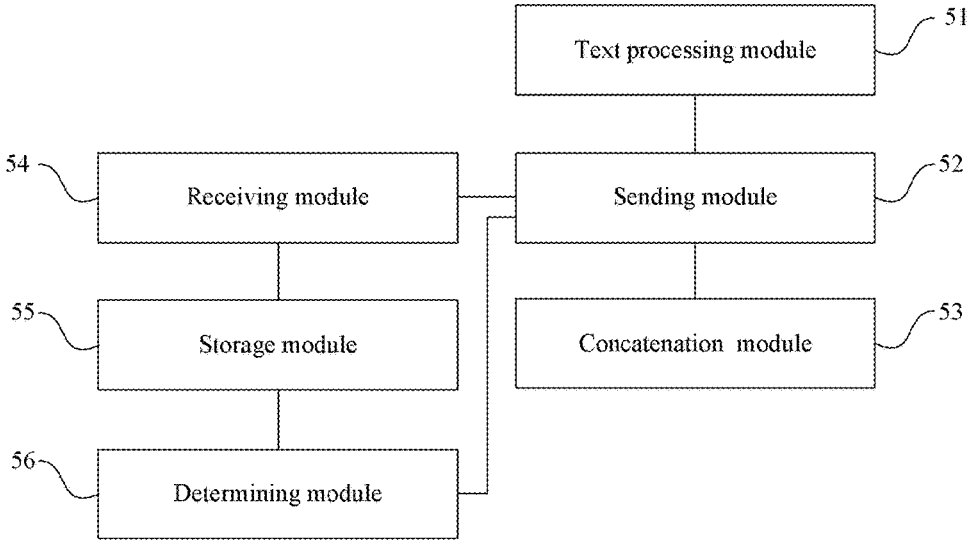
FIG. 6 is a block diagram of a speech synthesis apparatus according to another embodiment of the present disclosure.

FIG. 6 is a block diagram of a speech synthesis apparatus according to another embodiment of the present disclosure. A difference from the speech synthesis apparatus shown in FIG. 5 lies in that the speech synthesis apparatus shown in FIG. 6 may further include a concatenation module 53.

The concatenation module 53 is configured to concatenate speech data of the online speech synthesis system and speech data of the offline speech synthesis system after the speech synthesis is completed, to obtain complete speech synthesis data.

Further, the speech synthesis apparatus may further include: a receiving module 54 and a storage module 55.

The receiving module 54 is configured to receive speech data sent by the online speech synthesis system and corresponding to a sentence for which speech synthesis has been completed after the sending module 52 sends the to-be-synthesized text to the online speech synthesis system for speech synthesis, where the speech data corresponding to the sentence for which speech synthesis has been completed is obtained by the online speech synthesis system by performing punctuation for the to-be-synthesized text and performing speech synthesis for each sentence obtained after the punctuation.

The storage module 55 is configured to store the speech data received by the receiving module 54 and corresponding to the sentence for which speech synthesis has been completed.

For example, for a to-be-synthesized text t, when the network connection exists, the sending module 52 sends the to-be-synthesized text t to the online speech synthesis system, and after receiving the to-be-synthesized text t, the online speech synthesis system performs punctuation for the to-be-synthesized text t, to obtain [t1, t2, t3, . . . ], then performs speech synthesis for [t1, t2, t3, . . . ], and sends obtained speech data [a1, a2, a3, . . . ] to the client.

Further, the speech synthesis apparatus may further include a determining module 56.

The determining module 56 is configured to determine the text for which the online speech synthesis system has not completed speech synthesis, according to speech data that is received when the fault occurs in the online speech synthesis system or the network connection is disrupted and that corresponds to a sentence for which speech synthesis has been completed. For example, if a fault occurs in the online speech synthesis system in a process in which the online speech synthesis system performs speech synthesis or the network connection of the client is disrupted in an actual use process, the determining module 56 may determine, according to speech data (assumed as [a1, a2]) received when the fault occurs in the online speech synthesis system or the network connection is disrupted and corresponding to a sentence for which speech synthesis has been completed, that an error occurs when speech data corresponding to t3 is obtained. Therefore, the determining module 56 may determine that the text for which the online speech synthesis system has not completed speech synthesis is t3 and a subsequent text.

In this case, the sending module 52 is further configured to send the text for which the online speech synthesis system has not completed speech synthesis to the offline speech synthesis system for speech synthesis, to obtain speech data corresponding to the text for which the online speech synthesis system has not completed speech synthesis.

Specifically, after the determining module 56 determines that the text for which the online speech synthesis system has not completed speech synthesis is t3 and the subsequent text, the sending module 52 needs to forward t3 and the subsequent text to the offline speech synthesis system for speech synthesis, to obtain speech data [a3', . . . ] corresponding to t3 and the subsequent text.

In this embodiment, after the speech synthesis is completed, the concatenation module 53 may concatenate speech data of the online speech synthesis system and speech data of the offline speech synthesis system, to obtain complete speech synthesis data [a1, a2, a3', . . . ].

According to the speech synthesis apparatus, speech synthesis experience of a user can be improved, the limitation from a network environment can be overcome, and a speech synthesis request of the user can be completed in various network environments. In addition, a better synthesis effect can be obtained as compared with separate offline speech synthesis, and a speech synthesis service becomes more stable and reliable.

Embodiments of the present disclosure further provides an electronic device, and the electronic device includes: one or more processors; a memory; and one or more programs, stored in the memory, and when executed by the one or more processors, cause the following operations to be executed: processing a text, to obtain a to-be-synthesized text; when a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

Embodiment of the present disclosure further provides a non-transitory computer storage medium, having stored therein one or more modules that, when executed, cause the following operations to be executed: processing a text, to obtain a to-be-synthesized text; when a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

It should be noted that in the embodiments of the present disclosure, terms such as "first" and "second" are used only for a description purpose, and shall not be construed as indicating or implying relative importance. In addition, in the descriptions of the present disclosure, unless otherwise stated, "multiple" means two or more than two.

Any process or method in the flowcharts or described herein in another manner may be understood as indicating a module, a segment, or a part including code of one or more executable instructions for implementing a particular logical function or process step. In addition, the scope of preferred embodiments of the present disclosure include other implementations which do not follow the order shown or discussed, including performing, according to involved functions, the functions basically simultaneously or in a reverse order, which should be understood by technical personnel in the technical field to which the embodiments of the present disclosure belong.

It should be understood that the parts of the present disclosure may be implemented by hardware, software, firmware, or a combination thereof. In the implementation manners, multiple steps or methods may be implemented by using software or firmware that is stored in a memory and that is executed by an appropriate instruction execution system. For example, if hardware is used for implementation, as in another implementation manner, any one of or a combination of the following technologies known in the art may be used for implementation: a discrete logic circuit having a logic gate circuit configured to implement a logical function for a data signal, an application-specific integrated circuit having an appropriate combinational logic gate circuit, a programmable gate array (PGA), a field programmable gate array (FPGA), and the like.

A person of ordinary skill in the art may understand that all or part of the steps of the method of the embodiments may be implemented by a program instructing relevant hardware. The program may be stored in a computer readable storage medium. When the program is executed, one or a combination of the steps of the method embodiments is performed.

In addition, functional units in the embodiments of the present disclosure may be integrated into one processing module, or each of the units may exist alone physically, or two or more units may be integrated into one module. The integrated module may be implemented in a form of hardware or a software functional module. If implemented in a form of a software functional module and sold or used as an independent product, the integrated module may also be stored in a computer readable storage medium.

The aforementioned storage medium may be a read-only memory, a magnetic disk, or an optical disc.

In the descriptions of this specification, a description of a reference term such as "an embodiment", "some embodiments", "an example", "a specific example", or "some examples" means that a specific feature, structure, material, or characteristic that is described with reference to the embodiment or the example is included in at least one embodiment or example of the present disclosure. In this specification, exemplary descriptions of the foregoing terms do not necessarily refer to a same embodiment or example. In addition, the described specific feature, structure, material, or characteristic may be combined in an appropriate manner in any one or more embodiments or examples.

Although the embodiments of the present disclosure have been shown and described above, it may be understood that the embodiments are exemplary and cannot be construed as a limitation to the present disclosure, and a person of ordinary skill in the art can make changes, modifications, replacements, and variations to the embodiments without departing from the scope of the present disclosure.

What is claimed is:

1. A speech synthesis method, comprising:

processing a text, on an electronic device comprising one or more processors and memory, to obtain a to-be-synthesized text, wherein processing the text comprises performing punctuation and sentence segmentation, part-of-speech tagging, numeric character processing, pinyin annotation, and rhythm and pause prediction processing for the text;

if a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

2. The method according to claim 1, wherein after sending a text for which the online speech synthesis system has not completed speech synthesis to an offline speech synthesis system for speech synthesis, the method further comprises:

if the fault of the online speech synthesis system is removed or the network connection is recovered in a process in which the offline speech synthesis system performs speech synthesis, continuing to send a text for which the offline speech synthesis system has not completed speech synthesis to the online speech synthesis system for speech synthesis.

3. The method according to claim 1, wherein after processing a text to obtain a to-be-synthesized text, and before sending a text for which the online speech synthesis system has not completed speech synthesis to an offline speech synthesis system for speech synthesis, the method further comprises:

if the network connection does not exist, sending the to-be-synthesized text to the offline speech synthesis system for speech synthesis; and after the network connection is established, sending a text for which the offline speech synthesis system has not completed speech synthesis to the online speech synthesis system for speech synthesis.

4. The method according to claim 1, further comprising:

after the speech synthesis is completed, concatenating speech data of the online speech synthesis system and speech data of the offline speech synthesis system, to obtain complete speech synthesis data.

5. The method according to claim 1, wherein after sending the to-be-synthesized text to an online speech synthesis system for speech synthesis, the method further comprises:

receiving and storing speech data sent by the online speech synthesis system and corresponding to a sentence for which speech synthesis has been completed, wherein the speech data corresponding to the sentence for which speech synthesis has been completed is obtained by the online speech synthesis system by performing punctuation for the to-be-synthesized text and performing speech synthesis for each sentence obtained after the punctuation.

6. The method according to claim 5, wherein sending a text for which the online speech synthesis system has not completed speech synthesis to an offline speech synthesis system for speech synthesis comprises:

determining the text for which the online speech synthesis system has not completed speech synthesis according to speech data received when the fault occurs in the online speech synthesis system or the network connection is disrupted and corresponding to a sentence for which speech synthesis has been completed; and sending the text for which the online speech synthesis system has not completed speech synthesis to the offline speech synthesis system for speech synthesis, to obtain speech data corresponding to the text for which the online speech synthesis system has not completed speech synthesis.

7. An electronic device, comprising:

one or more processors;

a memory; and one or more programs, stored in the memory, and when executed by the one or more processors, cause the one or more processors to perform following operations:

processing a text, to obtain a to-be-synthesized text;

performing punctuation and sentence segmentation, part-of-speech tagging, numeric character processing, pinyin annotation, and rhythm and pause prediction processing for the text;

if a network connection exists, sending the to-be-synthesized text to an online speech synthesis system for speech synthesis; and if a fault occurs in the online speech synthesis system in a process in which the online speech synthesis system performs speech synthesis or the network connection is disrupted in an actual use process, sending a text for which the online speech synthesis system has not completed speech synthesis to an offline speech synthesis system for speech synthesis.

8. A non-transitory computer storage medium, having stored therein one or more modules that, when executed, cause a speech synthesis method to be executed, the speech synthesis method comprising:

processing a text, to obtain a to-be-synthesized text;

performing punctuation and sentence segmentation, part-of-speech tagging, numeric character processing, pinyin annotation, and rhythm and pause prediction processing for the text;

sending the to-be-synthesized text to an online speech synthesis system for speech synthesis; and sending a partial text of the text for which the online speech synthesis system has not completed speech synthesis to an offline speech synthesis system for speech synthesis after a fault occurs in the online speech synthesis system in a process in which the online speech synthesis system performs speech synthesis or the network connection is disrupted in an actual use process.

9. The electronic device according to claim 7, wherein after sending a text for which the online speech synthesis system has not completed speech synthesis to an offline speech synthesis system for speech synthesis, the one or more processor are further configured to perform following operations:

if the fault of the online speech synthesis system is removed or the network connection is recovered in a process in which the offline speech synthesis system performs speech synthesis, continuing to send a text for which the offline speech synthesis system has not completed speech synthesis to the online speech synthesis system for speech synthesis.

10. The electronic device according to claim 7, wherein after processing a text to obtain a to-be-synthesized text, and before sending a text for which the online speech synthesis system has not completed speech synthesis to an offline speech synthesis system for speech synthesis, the one or more processors are further configured to perform following operations:

if the network connection does not exist, sending the to-be-synthesized text to the offline speech synthesis system for speech synthesis; and after the network connection is established, sending a text for which the offline speech synthesis system has not completed speech synthesis to the online speech synthesis system for speech synthesis.

11. The electronic device according to claim 7, wherein after the speech synthesis is completed, the one or more processors are further configured to:

concatenate speech data of the online speech synthesis system and speech data of the offline speech synthesis system, to obtain complete speech synthesis data.

12. The electronic device according to claim 7, wherein after sending the to-be-synthesized text to an online speech synthesis system for speech synthesis, the one or more processors are further configured to:

receive and store speech data sent by the online speech synthesis system and corresponding to a sentence for which speech synthesis has been completed, wherein the speech data corresponding to the sentence for which speech synthesis has been completed is obtained by the online speech synthesis system by performing punctuation for the to-be-synthesized text and performing speech synthesis for each sentence obtained after the punctuation.

13. The electronic device according to claim 12, wherein the one or more processors are configured to:

determine the text for which the online speech synthesis system has not completed speech synthesis according to speech data received when the fault occurs in the online speech synthesis system or the network connection is disrupted and corresponding to a sentence for which speech synthesis has been completed; and send the text for which the online speech synthesis system has not completed speech synthesis to the offline speech synthesis system for speech synthesis, to obtain speech data corresponding to the text for which the online speech synthesis system has not completed speech synthesis.

14. The method according to claim 1, further comprising combining the online speech synthesis with the offline speech synthesis to form a final speech synthesis.

15. The method according to claim 8, further comprising combining the synthesized text of the online speech synthesis system with synthesized text from the partial text of the offline speech synthesis system.

16. The method according to claim 1, wherein processing the text is performed locally on a device to obtain segmented portions of the to-be-synthesized text prior to sending the to-be-synthesized text to the online speech synthesis system; and wherein sending the text for which the online speech synthesis system has not completed speech synthesis to an offline speech synthesis system is based upon the device not receiving one of the segmented portions of the be-synthesized text from the online speech synthesis system.

17. The method according to claim 8, wherein processing the text is performed locally on a device to obtain segmented portions of the to-be-synthesized text prior to sending the to-be-synthesized text to the online speech synthesis system; and wherein sending the partial text of the text for which the online speech synthesis system has not completed speech synthesis to an offline speech synthesis system is based upon the device not receiving one of the segmented portions of the be-synthesized text from the online speech synthesis system.

* * * * *